US007921576B2

(12) United States Patent
Lee

(10) Patent No.: US 7,921,576 B2
(45) Date of Patent: Apr. 12, 2011

(54) DRYING AND FREEZING METHOD WITHOUT COOLING MEDIUM

(75) Inventor: Jack Lee, Taichung (TW)

(73) Assignee: Po-Huei Chen, Chang Hua Hsien (TW)

( * ) Notice: Subject to any disclaimer, the term of this patent is extended or adjusted under 35 U.S.C. 154(b) by 463 days.

(21) Appl. No.: 12/057,351

(22) Filed: Mar. 27, 2008

(65) Prior Publication Data

US 2009/0241364 A1 Oct. 1, 2009

(51) Int. Cl.
*F26B 5/06* (2006.01)
*F26B 21/00* (2006.01)

(52) U.S. Cl. ..... 34/72; 34/79

(58) Field of Classification Search ..... 34/72, 79, 34/284; 62/5, 93, 238.2, 238.5
See application file for complete search history.

(56) References Cited

U.S. PATENT DOCUMENTS

| | | | | |
|---|---|---|---|---|
| 4,107,936 | A * | 8/1978 | Felder | 62/5 |
| 4,594,084 | A * | 6/1986 | Lopez | 62/5 |
| 6,401,463 | B1 * | 6/2002 | Dukhan et al. | 62/5 |
| 2007/0037507 | A1 * | 2/2007 | Liu | 454/229 |

FOREIGN PATENT DOCUMENTS

JP 2000262839 A * 9/2000

* cited by examiner

*Primary Examiner* — Jiping Lu

(57) ABSTRACT

A drying and freezing method without cooling medium comprises the steps of removing moisture, separating cold air from hot air and mixing the cold air with the hot air. Under the condition of no cooling medium, the above-mentioned steps separate the moisture from the compressed air, separate the cold air from the hot air and mix the cold air with the hot air. The system using the drying and freezing method without cooling medium comprises at least one air dryer having an air-moisture separation chamber for separating air from moisture and at least one separator having a separation chamber for separating cold air from hot air. The separator is connected to a pipeline to mix the cold air with the hot air.

6 Claims, 7 Drawing Sheets

DRYING AND FREEZING METHOD WITHOUT COOLING MEDIUM

BACKGROUND OF THE INVENTION

1. Field of the Invention

The present invention relates to a drying method and its system, and more particularly to a drying and freezing method without cooling medium and its system.

2. Description of the Prior Art

In order to meet the demand of the industry for compressed air (such as high pressure air is needed when driving a processing machine), since the unprocessed compressed air not only has a high humidity, but also has a high temperature, to solve the above-mentioned problems, a conventional freezing type drying system 90 (as shown in FIG. 1) is developed, which comprises an air tank 91, a pipeline filter 92, a freezing dryer 93, an oil mist filter 94, a precision filter 95 and a deodorizing filter 96.

However, the above-mentioned conventional freezing type drying system 90 still has the following disadvantages:

Firstly, the freezing type drying system 90 can only perform the drying process via the freezing dryer 93, and the freezing dryer 93 has to remove moisture and oil gas from the compressed air by using cooling medium, but the cooling medium is one of the factors to destroy the ozonosphere. As a result, the earth is directly exposed to a great amount of ultraviolet radiation, which will cause physiological and psychological harm to the biology live on the earth.

Secondly, a plurality of filters must be assembled to filter the compressed air, so it will waste installation cost and maintenance cost.

Therefore, how to solve the above-mentioned problems has become an important issue for the manufacturers.

The present invention has arisen to mitigate and/or obviate the afore-described disadvantages.

SUMMARY OF THE INVENTION

The primary objective of the present invention is to provide a drying and freezing method without cooling medium and its system which uses an air-moisture separator to separate the moisture from the compressed air, uses a separator to separate cold air from hot air, and mixes the cold air with the hot air.

To achieve the objective of the present invention, the drying and freezing method without cooling medium comprises the following steps:

removing moisture: guiding compressed air to a guiding space having at least two sizes of cross sections. With the variation of the cross sections of the guiding space, the compressed air will be collided in the guiding space, such that the flow rate of air is changed, so as to separate the moisture from the compressed air;

separating cold air from hot air: rotating the air produced by the step of removing moisture at a high speed, with the centrifugal force produced by rotation, the cold air and the hot air are separated;

mixing the cold air with the hot air: mixing the hot air and the cold air which are produced by the step of separating cold air from hot air, so as to adjust the temperature and control the flow rate of the air.

A system using the above-mentioned drying and freezing method without cooling medium comprises at least one air dryer and one separator. The air dryer is defined with an inlet and an outlet, and is formed with a receiving space. The inlet is provided for guiding the compressed air. In the receiving space is provided an air-moisture separation chamber having at least two guiding spaces that are connected with each other. The inlet and the outlet of the air dryer are connected to the air-moisture separation chamber, so as to separate the moisture from the compressed air. The separator is provided with a separation chamber and is defined with an inlet, a cold outlet and a hot outlet. The inlet, the cold outlet and the hot outlet of the separator are connected to the separation chamber. The inlet of the separator is connected to the outlet of the air dryer, so as to separate the cold air from the hot air. The hot outlet and the cold outlet of the separator are connected by a pipeline to mix the cold air with the hot air.

With the above-mentioned descriptions, the present invention has the following advantages:

Firstly, the system using the drying and freezing method without cooling medium is unnecessary to use cooling medium to separate the moisture from the compressed air and separate the cold air from the hot air, which is environmental and can reduce the harm to the earth's environment and biology.

Secondly, the system using the drying and freezing method without cooling medium is unnecessary to assemble a plurality of filters to filter the compressed air, which will reduce the installation cost and maintenance cost.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
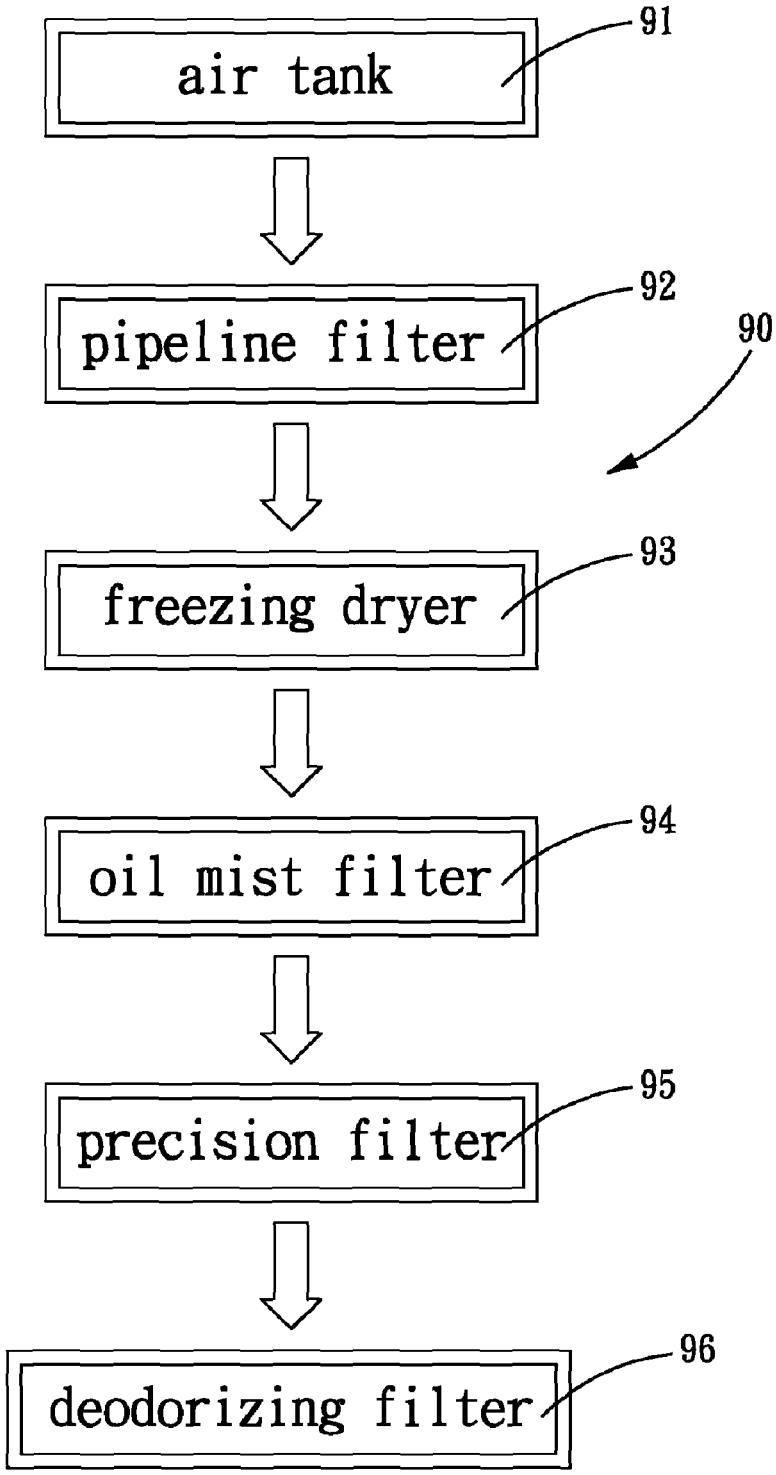
FIG. 1 PRIOR ART
FIG. 1 is a flow chart of a conventional freezing type drying system.
Figure 2:
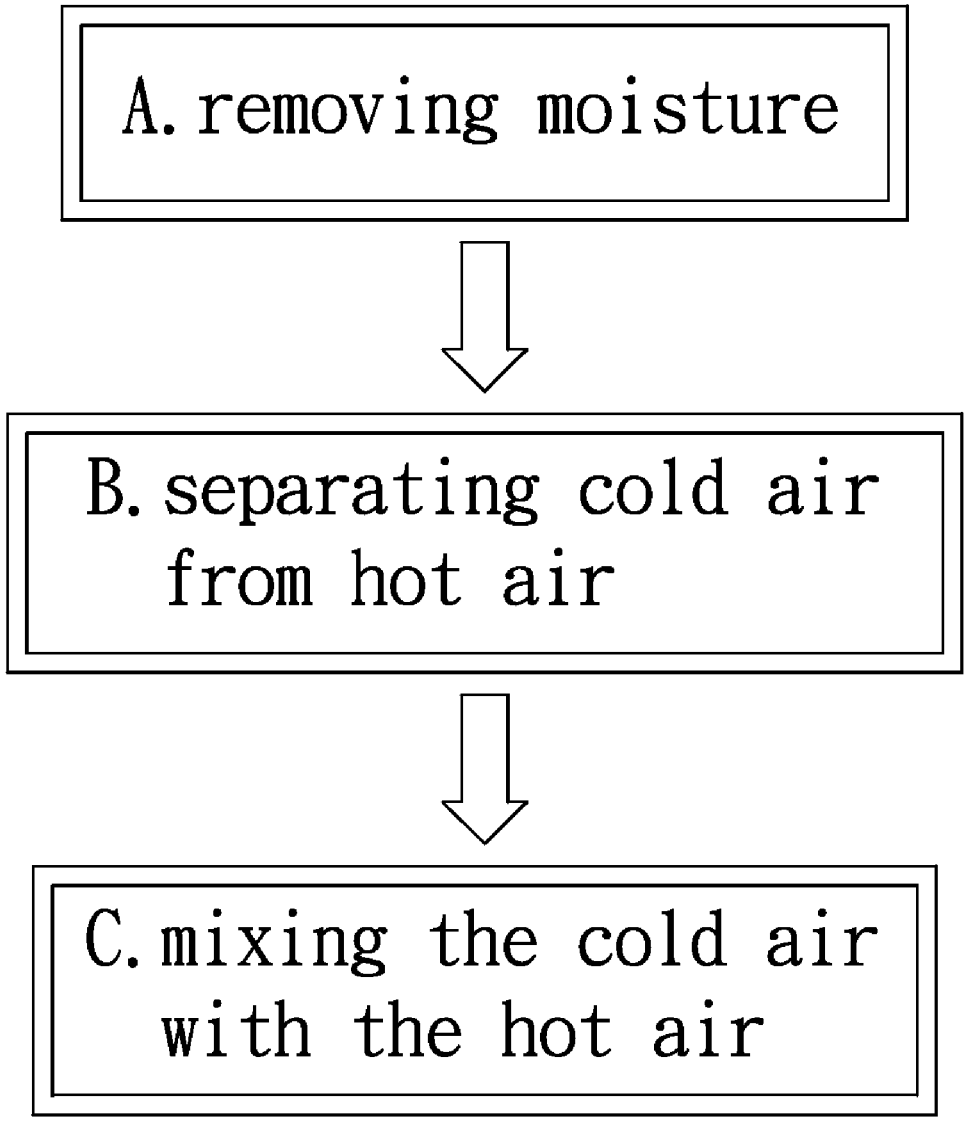
FIG. 2 is a flow chart of a drying and freezing method without cooling medium in accordance with the present invention.

Referring to FIG. 2, a drying and freezing method without cooling medium in accordance with the present invention comprises the following steps:

removing moisture: guiding compressed air to a guiding space having at least two sizes of cross sections. With the variation of the cross sections of the guiding space, the compressed air will be collided in the guiding space, such that the flow rate of air is changed, so as to separate the moisture from the compressed air;

separating cold air from hot air: rotating the air produced by the step of removing moisture at a high speed, with the centrifugal force produced by rotation, the cold air and the hot air are separated;

mixing the cold air with the hot air: mixing the hot air and the cold air which are produced by the step of separating cold air from hot air, so as to adjust the temperature and control the flow rate of the air.

Figure 3:
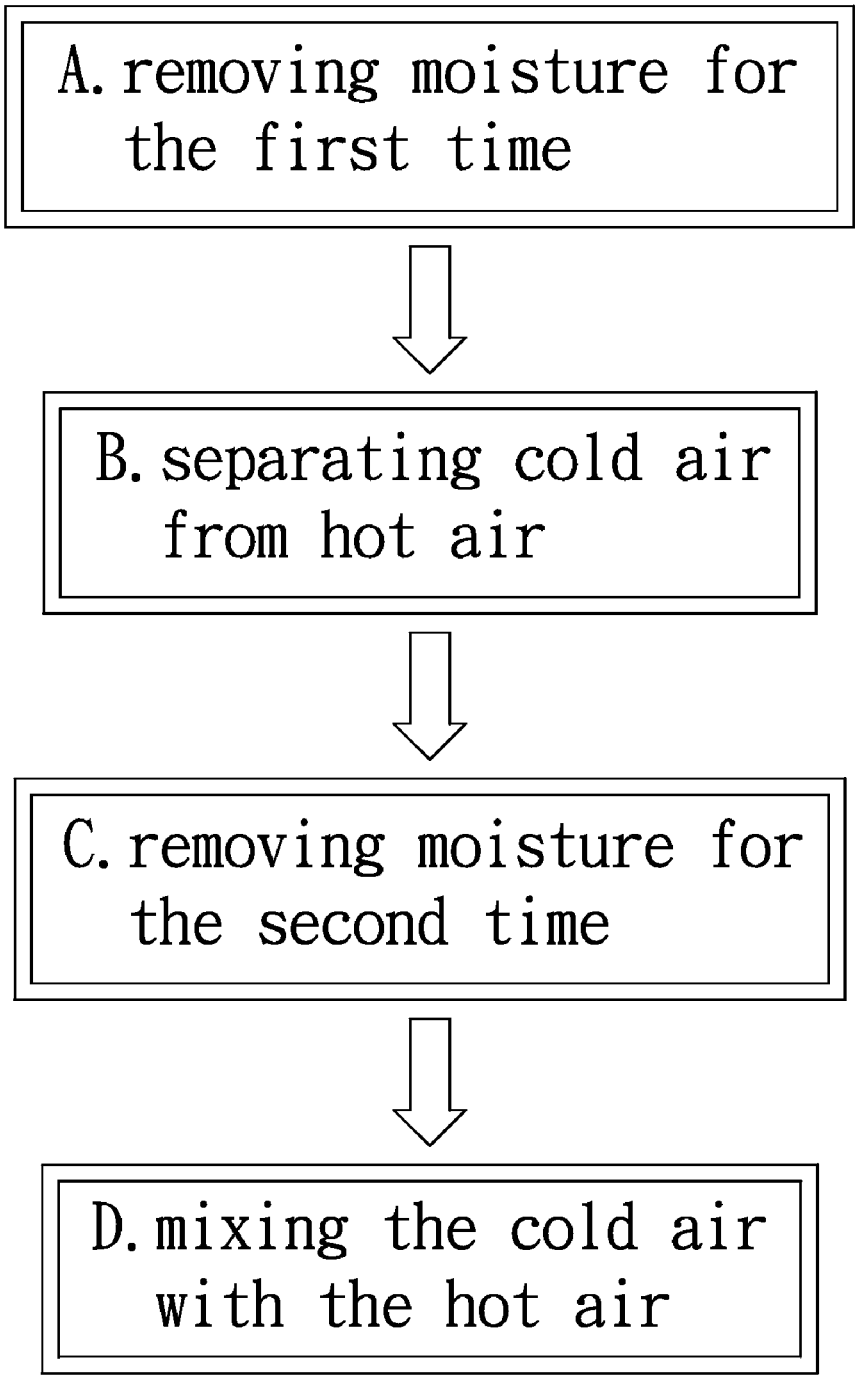
FIG. 3 is a flow chart of the drying and freezing method without cooling medium in accordance with the present invention.

The following drying and freezing method comprises an additional moisture-removing step (as shown in FIG. 3) that makes the following method different from the above-mentioned method, which comprises the steps of:

removing moisture for the first time: guiding compressed air to the guiding space having at least two sizes of cross sections. With the variation of the cross sections of the guiding space, the compressed air will be collided in the guiding space, such that the flow rate of air is changed, so as to separate the moisture from the compressed air;

separating cold air from hot air: rotating the air produced by the step of removing moisture at a high speed, with the centrifugal force produced by rotation, the cold air and the hot air are separated;

removing moisture for the second time: guiding the cold air produced by the step of separating cold air from hot air to the guiding space having at least two sizes of cross sections. With the variation of the cross sections of the guiding space, the compressed air will be collided in the guiding space, such that the flow rate of air is changed, so as to separate the moisture from the compressed air;

mixing the cold air with the hot air: mixing the hot air and the cold air which are produced by the step of separating cold air from hot air, so as to adjust the temperature and control the flow rate of the air.

The above-mentioned second moisture-removing step is designed for large flow rate and can be avoided when the flow rate is small.

A system using the above-mentioned drying and freezing method without cooling medium comprises a plurality of air dryers 10 and a separator 20.

Figure 4:
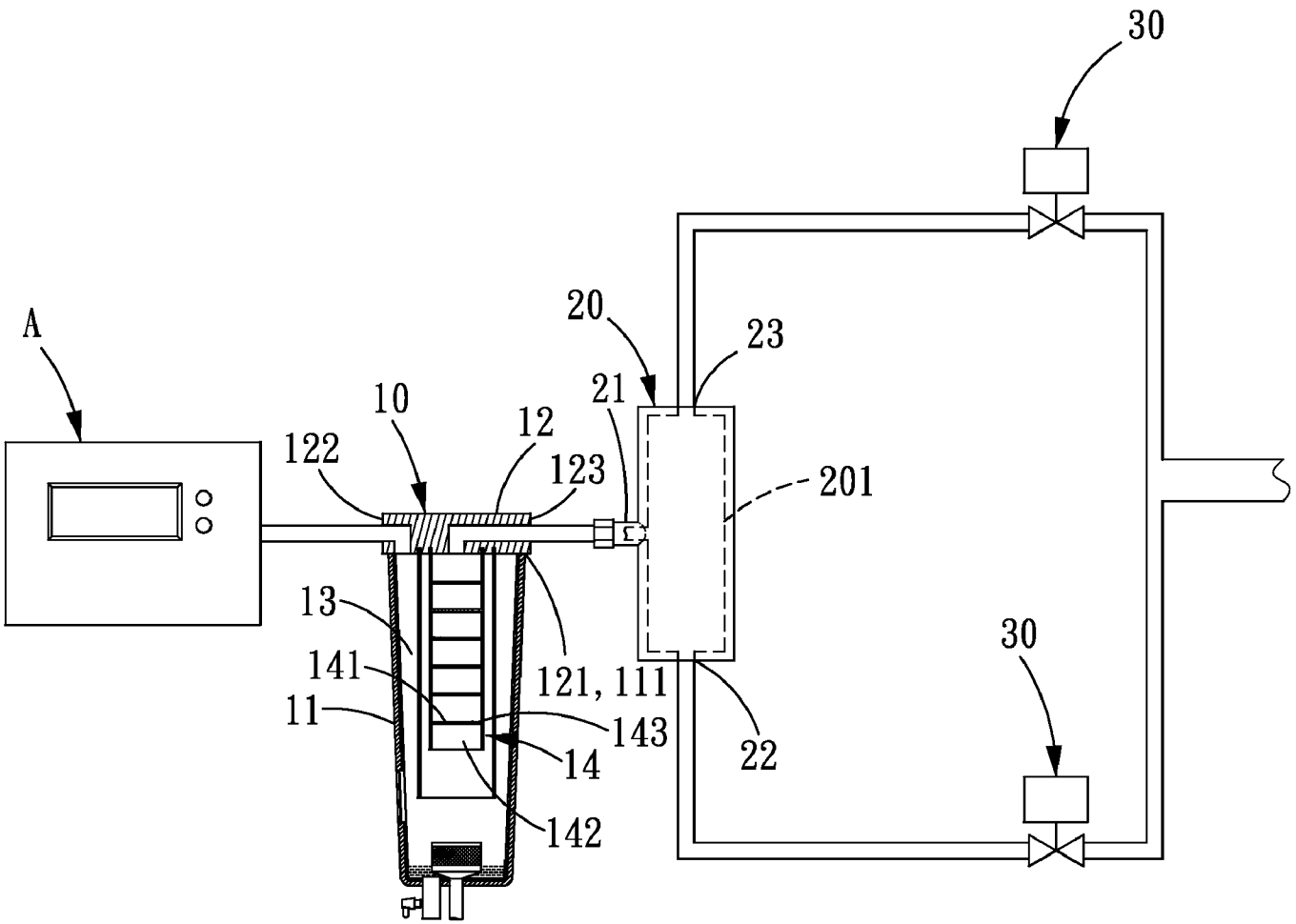
FIG. 4 is an assembly perspective view showing one air dryer being assembled to the system using the drying and freezing method without cooling medium in accordance with the present invention.

Referring to FIG. 4, the air dryer 10 comprises a cylinder 11 and a cover 12. One side of the cylinder 11 is provided with an assembling portion 111, and one side of the cover 12 is provided with an assembling portion 121. Each of the assembling portions 111, 121 is formed with a thread section for enabling the cylinder 11 and the cover 12 to be screwed with each other. The cover 12 is defined with an inlet 122 and an outlet 123. The cylinder 11 is combined with the cover 12 to form a receiving space 13. The cylinder 11 can also be integral with the cover 12 to form the receiving space 13 without the assembling portions 111, 121.

In the receiving space 13 is provided an air-moisture separation chamber 14 having at least one laminar separating member 141 which divides the air-moisture separation chamber 14 into at least two guiding spaces 142. The separating member 141 is defined with an air hole 143, such that the guiding spaces 142 are connected with each other. The air holes 143 of the separating members 141 must be arranged in a stagger manner, such that the compressed air moves in a tortuous pattern in the guiding spaces 142 to increase the times of collision, thus further increasing the adhesion amount of moisture and oil gas. The inlet 122 and the outlet 123 of the cover 12 are connected to both ends of the air-moisture separation chamber 14, such that the compressed air (the present invention utilizes an air compressor A to provide the compressed air) flows into the inlet 122 of the cover 12, then passes through the air hole 143 of each separating member 141 of the air-moisture separation chamber 14, and finally is discharged from the outlet 123 of the cover 12.

The separator 20 is provided with a separation chamber 201 and is defined with an inlet 21, a cold outlet 22 and a hot outlet 23. The inlet 21, the cold outlet 22 and the hot outlet 23 are connected to the separation chamber 201. The cold outlet 22 and the hot outlet 23 are located at both ends of the separation chamber 201, and the inlet 21 is provided at one side of the separation chamber 201 and is connected to the outlet 123 of the air dryer 10.

When the air enters the separation chamber 201 from the inlet 21 of the separator 20, it is sprayed out from the inlet 21 into the separation chamber 201 and then rotates in the separation chamber 201 at a high speed, so as to produce a centrifugal force. With the effect of the centrifugal force, the pressure and density of the air close to an inner wall of the separation chamber 201 will be increased, and the pressure and density of the air away from the inner wall of the separation chamber 201 will be decreased, such that the air with high pressure and density will flow to the air with low pressure and density. With the pressure change in the separation chamber 201, the hot air will be discharged from the hot outlet 23, and the cold air will be discharged from the cold outlet 22. Finally, the hot outlet 23 and the cold outlet 22 of the separator 20 are connected by a pipeline to mix the cold air with the hot air.

Referring to FIG. 4 again, in order to adjust the air flow rate of the hot outlet 23 and the cold outlet 22 of the separator 20, the diameter of the pipelines provided at the hot outlet 23 and the cold outlet 22 can also be designed to be changeable to restrict the flow rate, for example, the diameter of the hot outlet 23 of the separator 20 can be larger than, or smaller than or equal to that of the cold outlet 22. Also, each of the hot outlet 23 and the cold outlet 22 can be assembled with a control valve 30 having a changeable opening to restrict the flow rate.

Figure 5:
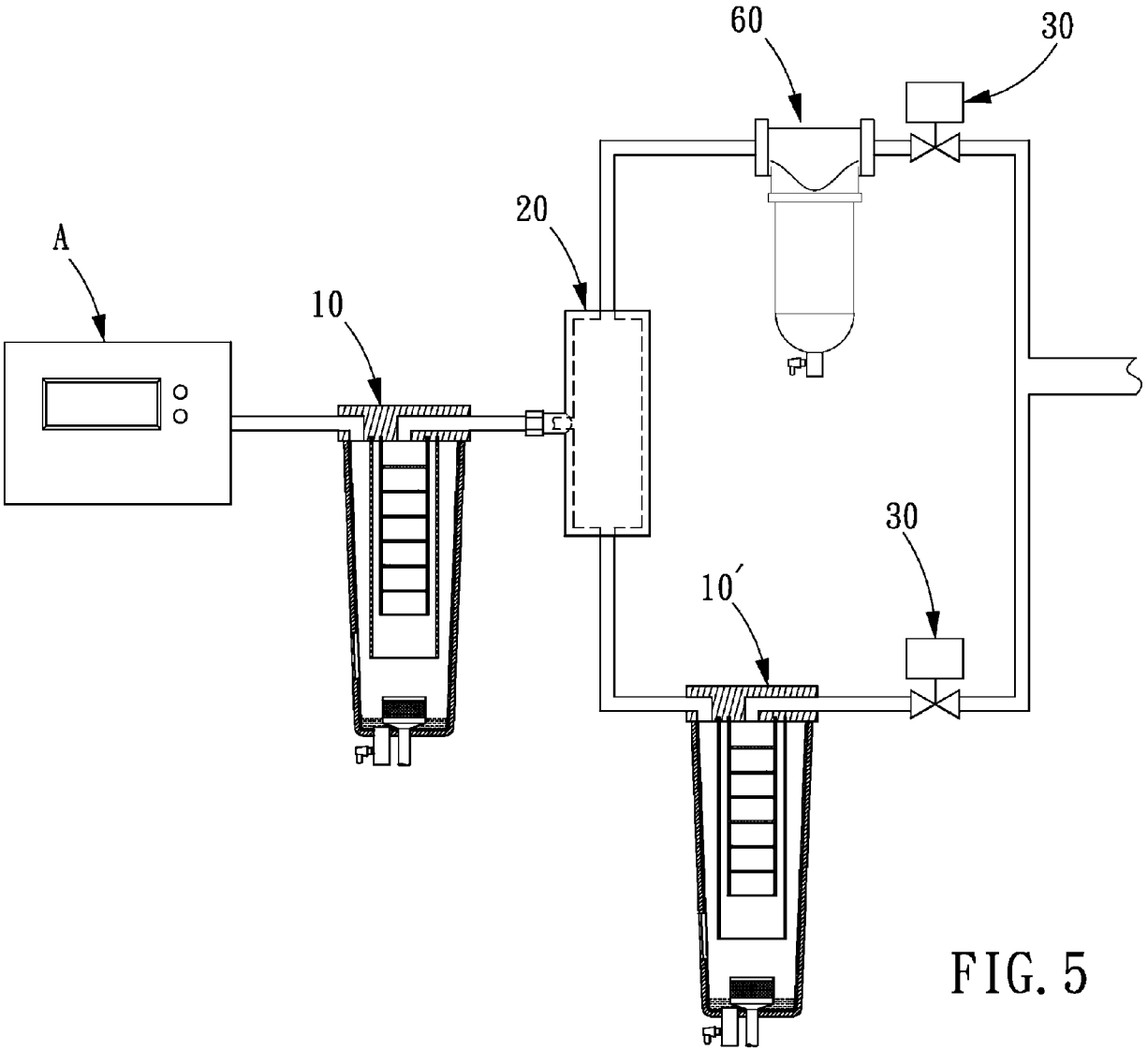
FIG. 5 is an assembly perspective view showing two air dryers being assembled to the system using the drying and freezing method without cooling medium in accordance with the present invention.

Referring to FIG. 5, in order to process compressed air of high flow rate, the cold air discharged from the cold outlet 22 often contains moisture, at this moment, an air dryer 10' must be assembled to the cold outlet 22. The hot air discharged from the hot outlet 23 often contains oil gas, at this moment, an oil-gas separator 60 must be assembled to the hot outlet 23.

Figure 6:
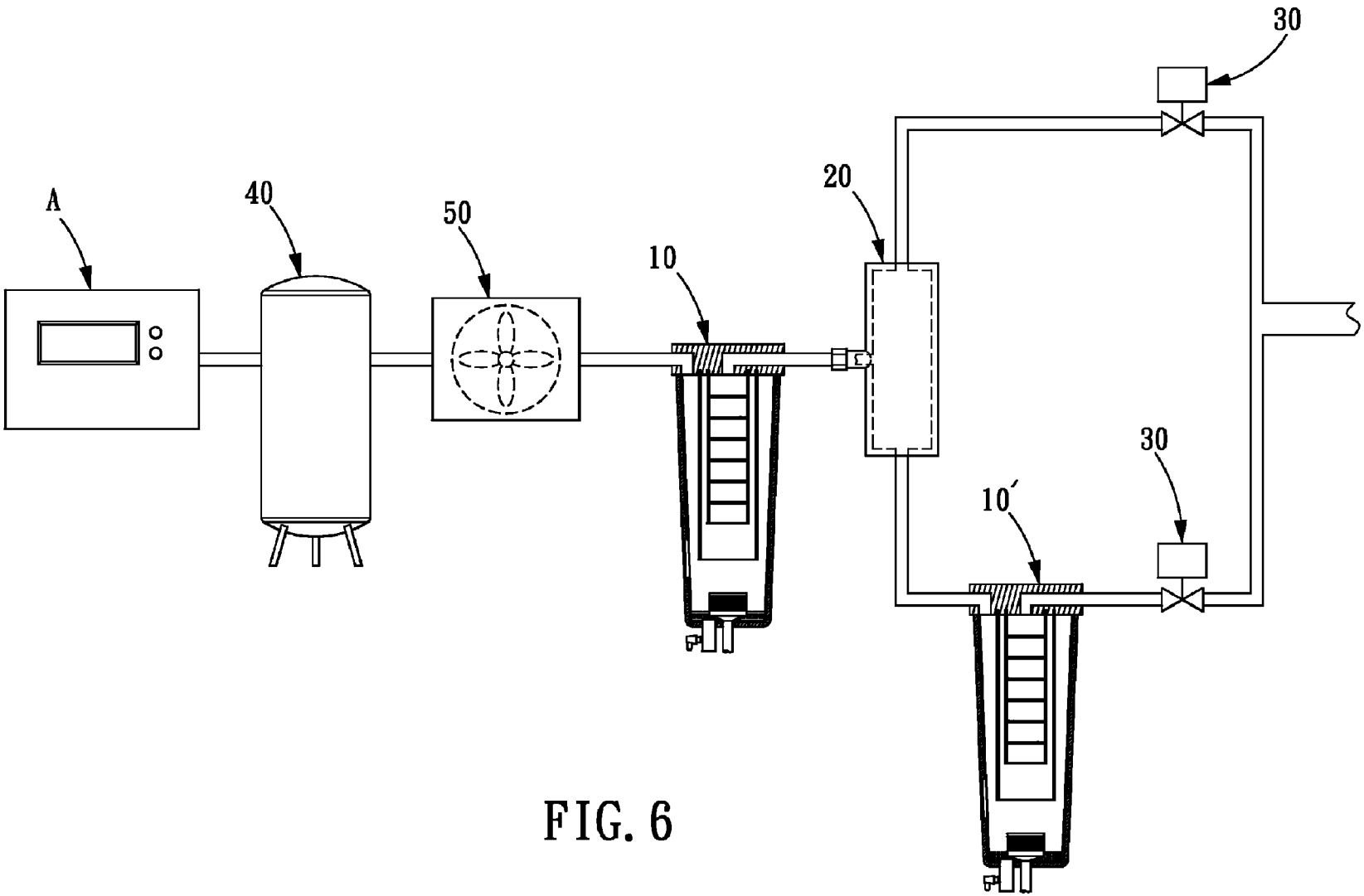
FIG. 6 is an assembly perspective view showing two air dryers, one fan and one air tank being assembled to the system using the drying and freezing method without cooling medium in accordance with the present invention.
Figure 7:
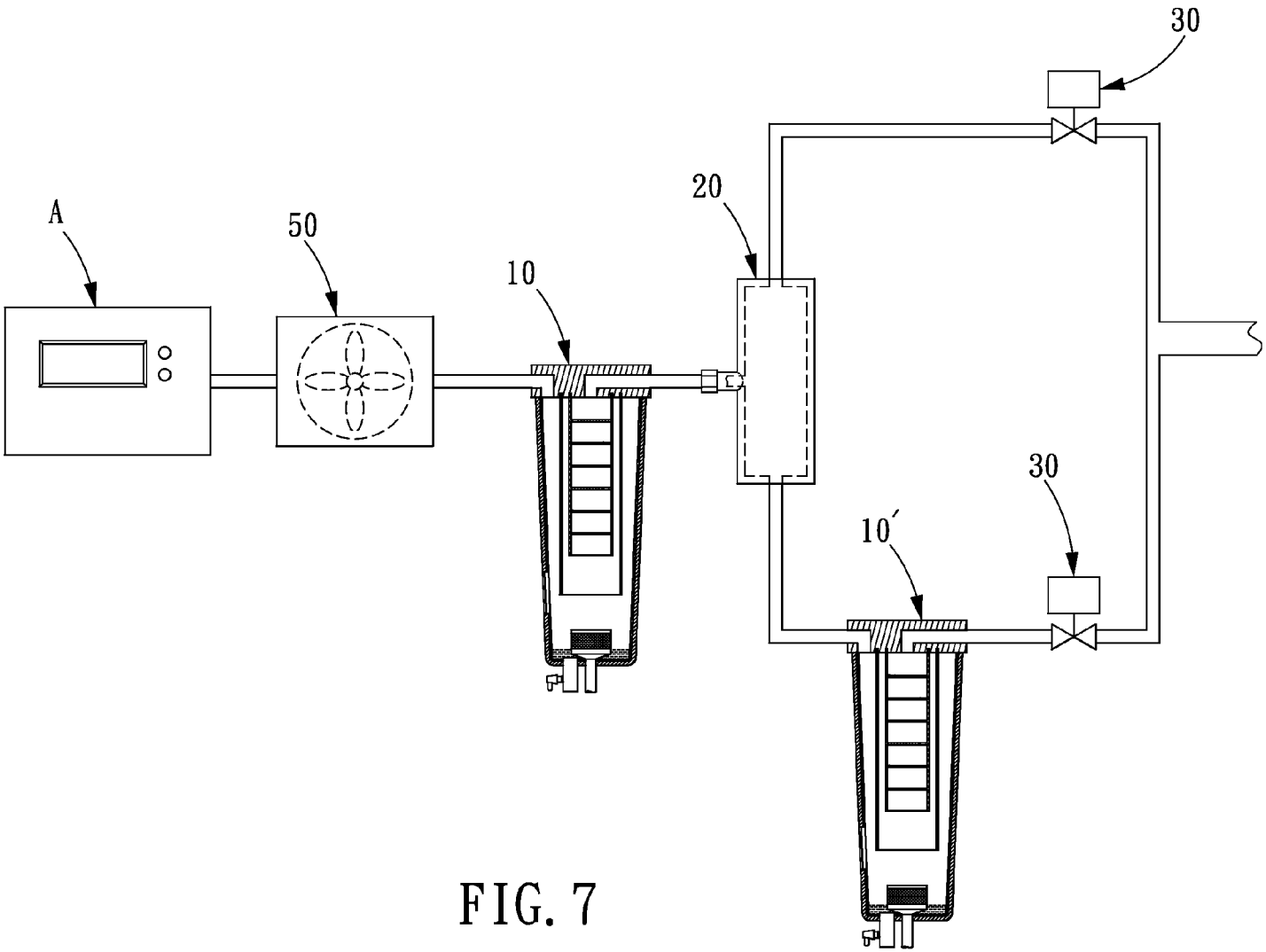
FIG. 7 is an assembly perspective view showing two air dryers and one fan being assembled to the system using the drying and freezing method without cooling medium in accordance with the present invention.

Referring to FIG. 6, in order to process high temperature compressed air, the pipeline connected to the inlet 122 of the air dryer 10 is assembled with an air tank 40 into which the compressed air is guided, that is, the compressed air is guided from a small space to a large space, such that the flow rate of the compressed air is reduced, so as to achieve a cooling effect. The air tank 40 is also used to stabilize pressure of the compressed air. In addition, the pipeline connected between the air tank 40 and the air dryer 10 can be assembled with a fan 50 for dissipating its heat energy. Thereby, the air tank 40 and the fan 50 (as shown in FIG. 7) can be selectively used according to the flow rate and the temperature of the compressed air. Moreover, as to the air compressor A which has been designed to have a function of cooling the compressed air, it is unnecessary to assemble the above-mentioned air tank 40 and fan 50.

To summarize, the drying and freezing method without cooling medium comprises the steps of removing moisture, separating cold air from hot air and mixing the cold air with the hot air. Under the condition of no cooling medium, the above-mentioned steps separate the moisture from the compressed air, separate the cold air from the hot air and mix the cold air with the hot air. The system using the drying and freezing method without cooling medium comprises at least one air dryer having an air-moisture separation chamber for separating air from moisture and at least one separator having a separation chamber for separating cold air from hot air. The separator is connected to a pipeline to mix the cold air with the hot air.

While we have shown and described various embodiments in accordance with the present invention, it should be clear to those skilled in the art that further embodiments may be made without departing from the scope of the present invention.

What is claimed is:

1. A system using a drying and freezing method without cooling medium, comprising:

at least one air dryer being defined with an inlet and an outlet, and formed with a receiving space, the inlet of the air dryer being provided for guiding a compressed air, in the receiving space being provided an air-moisture separation chamber having at least one separating member which divides the air-moisture separation chamber into at least two guiding spaces, the separating member being defined with an air hole, such that the guiding spaces are connected with each other, the inlet and the outlet of the air dryer being connected to the air-moisture separation chamber, so as to separate moisture from the compressed air;

at least one separator being provided with a separation chamber and defined with an inlet, a cold outlet and a hot outlet, the inlet, the cold outlet and the hot outlet of the separator being connected to the separation chamber, the inlet of the separator being connected to the outlet of the air dryer, so as to separate cold air from hot air, and the hot outlet and the cold outlet of the separator being connected by a pipeline to mix the cold air with the hot air;

wherein an additional air dryer is assembled to a pipeline connected to the cold outlet of the separator.

2. The system using a drying and freezing method without cooling medium as claimed in claim 1, wherein a control valve is assembled to the hot outlet or the cold outlet of the separator to restrict a flow rate of air.

3. The system using a drying and freezing method without cooling medium as claimed in claim 1, wherein an oil-gas separator is assembled to a pipeline connected to the hot outlet of the separator.

4. The system using a drying and freezing method without cooling medium as claimed in claim 1, wherein an air tank is assembled to a pipeline connected to the inlet of the air dryer.

5. The system using a drying and freezing method without cooling medium as claimed in claim 1, wherein a fan is assembled to a pipeline connected to the inlet of the air dryer.

6. The system using a drying and freezing method without cooling medium as claimed in claim 1, wherein an air tank and a fan are assembled to a pipeline connected to the inlet of the air dryer.

* * * * *